United States Patent [19]

Teichmann

[11] 4,167,803

[45] Sep. 18, 1979

[54] APPARATUS FOR DETECTING FOREIGN BODIES IN A TEXTILE LAP

[75] Inventor: Paul G. Teichmann, Mönchen-Gladbach, Fed. Rep. of Germany

[73] Assignee: Trützschler GmbH & Co. KG, Mönchen-Gladbach, Fed. Rep. of Germany

[21] Appl. No.: 868,748

[22] Filed: Jan. 12, 1978

[30] Foreign Application Priority Data

Jan. 12, 1977 [DE] Fed. Rep. of Germany ..... 2700972

[51] Int. Cl.[2] ..... D01G 31/00

[52] U.S. Cl. ..... 19/0.2; 226/1; 226/43; 226/45

[58] Field of Search ..... 226/1, 10, 45, 43; 324/228, 234, 236, 239; 340/259; 200/61.09, 61.13; 19/0.2, 0.23, 0.25, 0.26

[56] References Cited

U.S. PATENT DOCUMENTS

| | | | |
|---|---|---|---|
| 1,395,877 | 11/1921 | Tillotson | 19/105 |
| 1,427,077 | 8/1922 | Molloy | 19/105 |
| 3,092,875 | 6/1963 | McLean | 19/0.23 |
| 3,418,697 | 12/1968 | Groce et al. | 19/105 |
| 3,588,686 | 6/1971 | Lingmann et al. | 340/259 X |

OTHER PUBLICATIONS

Publication "——for Conveyors" , pp. 81–83 of Electronics, Jul. 1949.

*Primary Examiner*—Dorsey Newton
*Attorney, Agent, or Firm*—Spencer & Kaye

[57] ABSTRACT

An apparatus for detecting metallic bodies in a running textile lap performs the steps of generating a high-frequency electromagnetic field; passing the textile lap through the high-frequency electromagnetic field; and deriving a sensor signal as a function of an alteration of the high-frequency electromagnetic field caused by the presence of a metallic body in the lap.

16 Claims, 4 Drawing Figures

APPARATUS FOR DETECTING FOREIGN BODIES IN A TEXTILE LAP

BACKGROUND OF THE INVENTION

This invention relates to an apparatus for monitoring the presence of metallic foreign bodies in a textile lap which is fed, for example, into a carding machine.

According to a known method, the driving torque for the feed roller of the carding machine is limited by means of, for example, a slip clutch. The foreign body carried by the advancing lap enters the bite of the feed roller and increases the torque resisting the roller drive. By virtue of the slip clutch, the roller drive continues its rotation, while the feed roller is at a standstill. This known method, however, is adapted to react only to relatively large and hard foreign bodies (that is, impurities having a relative high physical resistance). Further, an arrangement achieving torque limitation involves substantial expense.

French Pat. No. 1,411,766 discloses another type of sensing system for stopping the feed rollers upon detecting foreign bodies in a textile lap. As disclosed in this patent, in case the textile lap, passed between the feed roll and the feed table, contains undesirable foreign bodies, the latter displace the feed roll vertically upwardly against a spring-biased contact which, in turn, electronically causes stoppage of the feed roller. The sensing proper of the foreign bodies is thus effected by mechanical contacting. Such a mechanical detection is again effective only in case of relatively large and hard foreign bodies. Further, the shiftable bearing for the feed roller is a likely source of malfunctioning. Also according to this French patent, apart from the mechanical detection of foreign bodies, the fleece delivered by the carding machine is optically monitored by means of a light beam and a light barrier to detect ruptures or other defects in the fleece. It is apparent that while light beam testing of various quality-determining properties of the fleece is feasible, a light-beam monitoring is not adapted for the detection of foreign bodies embedded in the textile material.

German Pat. No. 1,510,191 and British Pat. No. 1,147,374 disclose the application of a high-frequency electromagnetic field across the running textile lap for the purpose of directly eliminating metallic foreign bodies. As the foreign body passes through the high-frequency field, it is heated thereby and thus it burns its way through the textile lap and is in this manner directly eliminated therefrom. It is a disadvantage of this method that it involves a local weakening and destruction of the lap. Thus, the method disclosed in these two patents is concerned with the direct elimination of foreign bodies and gives thus no consideration to a detection that makes possible a subsequent gentle removal of foreign bodies.

SUMMARY OF THE INVENTION

It is an object of the invention to provide an improved apparatus for detecting, without mechanically moving parts, the presence of metallic foreign bodies of smaller dimensions and less hard consistency than required for the effective operation of prior art arrangements.

This object and others to become apparent as the specification progresses, are accomplished by the invention, according to which, briefly stated, the apparatus for detecting metallic bodies in a running textile lap performs the steps of generating a high-frequency electromagnetic field; passing the textile lap through the high-frequency electromagnetic field; and deriving a sensor signal as a function of an alteration of the high-frequency electromagnetic field caused by the presence of a metallic body in the lap.

By passing the textile web through a high-frequency electromagnetic field which, for the purposes of this disclosure is meant to be between 10 kHz and 3,000 MHz, metallic foreign bodies of all kinds and dimensions can be reliably detected. The electrically or magnetically conducting foreign bodies cause an alteration of the high-frequency electromagnetic field; this change in the field is converted into a sensor signal for further use.

By virtue of the above-outlined use of a high-frequency electromagnetic field, the detection of metallic foreign bodies is possible in a simple and operationally safe manner.

Expediently, the sensor signal controls the feed roller drive, so that in case of an alteration of the high-frequency field due to the passage of a metallic foreign body, a further advance of the textile lap is interrupted to permit a subsequent removal of the detected foreign body.

The apparatus according to the invention includes a lap feed ramp, an arrangement for generating a high-frequency electromagnetic field at a location of the ramp across its entire width and an arrangement for generating a sensor signal in response to an alteration of the electromagnetic field caused by the presence of a metallic foreign body in the lap. The output of the sensor signal generating arrangement is connected to a switch in the circuit for driving a feed roller of a carding machine. The sensor signal controls the switch and thus effects stoppage of the feed roller when a metallic foreign body is present in the high-frequency electromagnetic field.

The arrangement for generating the high-frequency electromagnetic field includes an oscillator generating a high-frequency voltage and a component, such as a coil (with or without a core), supported in the zone of the lap feed ramp and connected to the oscillator. Such an arrangement is not sensitive to external effects and needs practically no maintenance.

Advantageously, the lap feed ramp is made of a synthetic material through which the high-frequency electromagnetic field passes. Such a component is inexpensive to manufacture. In order to enhance the feed to the feed roller, the lap feed ramp slopes downwardly.

According to a feature of the invention, the high-frequency electromagnetic field is generated by a one-piece component arranged either on the underside or above the lap feed ramp.

According to a further feature of the invention, the field-generating component is formed of two parts; one part is arranged on the underside of the lap feed ramp, while the other part is supported thereabove. In this manner, a closed coil configuration and thus an intensified and long-range effect can be obtained.

According to a further advantageous feature of the invention, the proximity sensor device (that is, the arrangements for generating the high-frequency electromagnetic field and for generating the sensor signal in response to a field alteration) is formed of a transmitter part and a receiver part, whose respective transmitting and receiving antennae are preferably arranged in a frame in a parallel relationship behind one another as viewed in the direction of lap advance. The lap is passed through an opening in the frame surrounded by the loops of the two antennae.

DESCRIPTION OF THE PREFERRED EMBODIMENTS

Figure 1:
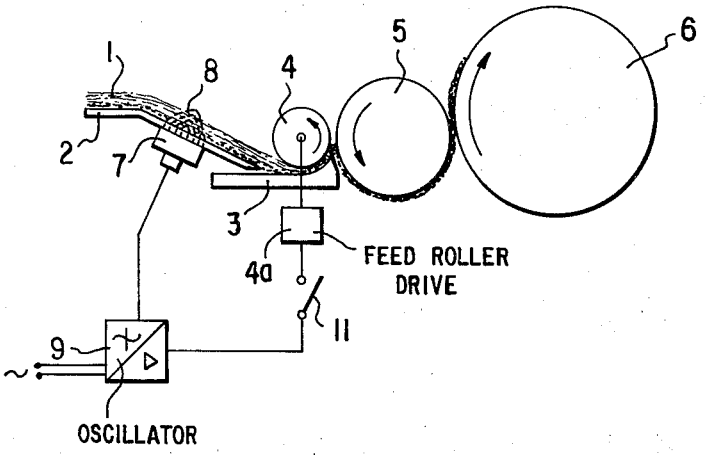
FIG. 1 is a schematic side elevational view of a preferred embodiment of the invention.

Turning now to FIG. 1, a textile lap is advanced on a lap feed ramp 2, made of a synthetic material (such as acrylic glass, pertinox, hard paper or hard fabric), to a feed table 3 where it is grasped by a feed roller 4 and is advanced to a lickerin 5 of a cylinder 6 of a carding machine. Along the entire width of the lap feed ramp 2, there are arranged electromagnetic field generating components 7. The latter are connected to an oscillator 9 which supplies the components 7 with a voltage of high frequency in the 10 kHz–3000 MHz range for generating the high-frequency electromagnetic field 8.

If, during operation, a metallic foreign body contained in the advancing lap passes through the high-frequency electromagnetic field 8, the latter induces eddy currents in the metallic body. The eddy currents weaken the electromagnetic field 8, drawing additional energy from the oscillator 9 to such an extent that the signal amplitude is decreased. This changed condition in the oscillator 9 causes the generation of a sensor signal which opens an on-off switch 11 in the circuit of the drive 4*a* of the feed roller 4. Thus, the presence of a metallic foreign body causes, by virtue of contactless detection, an automatic stoppage of the feed roller 4, whereafter the foreign body (which is still upstream of the carding machine) may be removed. After removal of the foreign body, the normal electromagnetic field 8 is re-established, causing closure of the switch 11 and thus the feed roller 4 is automatically restarted.

Figure 2:
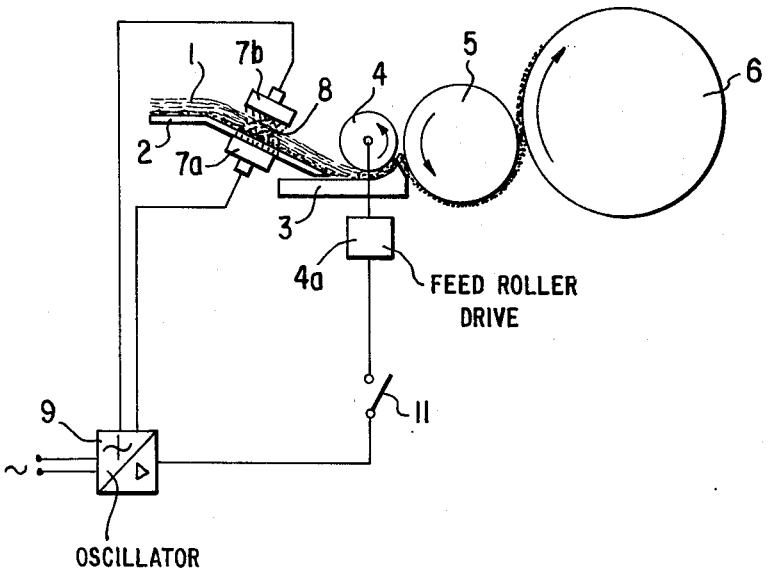
FIG. 2 is a schematic side elevational view of a further embodiment of the invention.

According to the embodiment illustrated in FIG. 2, the proximity sensor has a field generating component 7*a* attached to the underside of the lap feed ramp 2 and a field generating component 7*b* arranged above the lap feed ramp 2 in alignment with the lower component 7*a*. In other aspects the embodiment shown in FIG. 2 is identical to that of FIG. 1.

The signal applied to the switch 11 is generated in a manner known by itself. Thus, a high-frequency electromagnetic alternating field is built up and reduced successively and in a progressing manner in the components (proximity sensors) 7 or 7*a*, 7*b*. As long as no metallic foreign body is present in any of these alternating fields, no weakening of the field occurs. As soon as such a foreign body is present in the range of the alternating field, the latter is weakened, so that the respective proximity sensor applies a signal to the switch 11.

Figure 3:
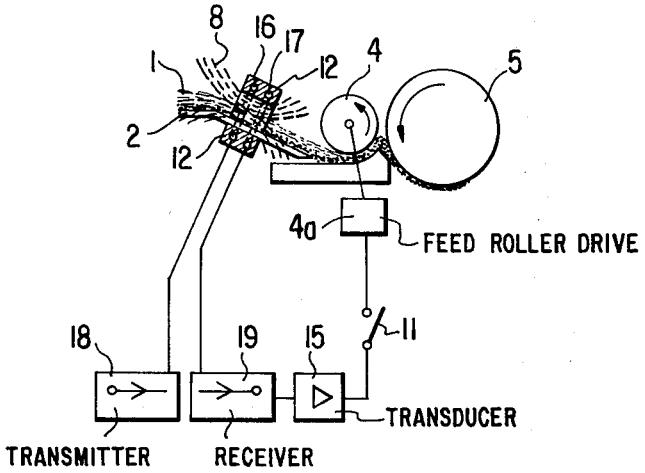
FIG. 3 is a schematic side elevational and block diagram view of another preferred embodiment of the invention.
Figure 4:
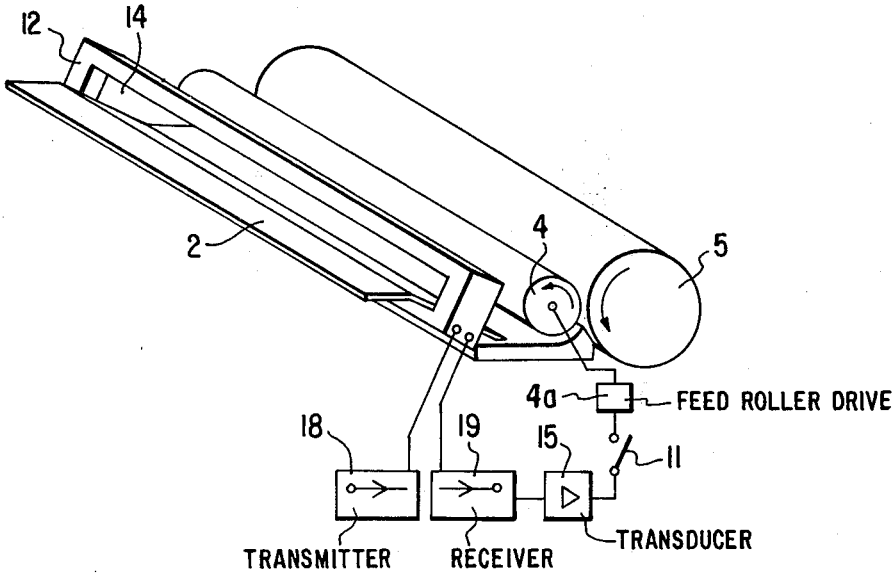
FIG. 4 is a schematic perspective view of the embodiment illustrated in FIG. 3.

Turning now to the embodiment illustrated in FIGS. 3 and 4, the lap feed ramp 2 is surrounded by a rectangular frame 12, the length dimension of which is oriented transversely to the direction of lap advance on the lap feed ramp 2. Within the frame body, generally following its configuration, there are arranged a rectangular transmitting antenna 16 and, downstream thereof (as viewed in the direction of lap advance) and in a parallel relationship therewith, a rectangular receiving antenna 17. The transmitting antenna 16 is coupled to a high-frequency transmitter 18 for generating the electromagnetic field 8. The receiving antenna 17 is coupled to a receiver 19 for sensing changes in the field 8 as a result of the presence of a metallic foreign body therein.

In operation, the textile lap 1 advances on the lap feed ramp 2 and passes through the opening 14 of the frame 12 and thus passes first through the loop of the antenna 16 of the transmitter 18 and then through the loop of the antenna 17 of the receiver 19. Signals derived from the high-frequency electromagnetic field 8 emitted by the antenna 16 of the transmitter 18 are, via the antenna 17 and the receiver 19, applied to a transducer 15 which, in turn, is coupled with the switch 11 for controlling the drive of the feed roller 4 of the carding machine. In case a metallic foreign body contained in the textile lap passes the frame 12, the electromagnetic field 8 is distorted and altered by the eddy currents induced in the foreign body. These changes are sensed by the receiver 19 and are amplified by the transducer 15. The output of the transducer 15 is applied to the switch 11 which stops or, upon subsequent removal of the foreign body, restarts the feed roller 4.

A signal applied to the switch 11 is generated in a manner known by itself. For this purpose, in FIG. 1 there are arranged several proximity sensors and in FIG. 2 there are arranged several proximity sensors 7*a*, 7*b* in juxtaposition. A high-frequency electromagnetic alternating field is built up and reduced successively and in a progressing manner in these proximity sensors. As long as no foreign body is present in any of these alternating fields, no weakening of the alternating field occurs. However, as soon as such a foreign body is present in the range of the alternating field of a proximity sensor, this alternating field is weakened, so that this proximity sensor applies a signal to the switch 11. The synthetic material of which the lap feed ramp 2 is made may be, for example, acrylic glass, Pertinax, hard paper, hard fabric.

It will be understood that the above description of the present invention is susceptible to various modifications, changes and adaptations, and the same are intended to be comprehended within the meaning and range of equivalents of the appended claims.

What is claimed is:

1. In a detector apparatus for stopping the rotation of a feed roller of a carding machine in the presence of a metallic foreign body in a textile lap advancing to the feed roller, the improvement comprising (a) a lap feed ramp arranged at said feed roller for supporting the lap;

(b) first means for generating a high-frequency electromagnetic field in the zone of said lap feed ramp substantially along the entire width thereof measured transversely to the direction of lap advance; said first means comprising an oscillator means for generating a high-frequency voltage and a component attached to an underside of said lap feed ramp and connected to said oscillator means to receive said high-frequency voltage for generating said high-frequency electromagnetic field;

(c) second means for deriving a sensor signal in response to an alteration of the high-frequency electromagnetic field caused by the presence of a metallic foreign body in said field; and (d) a switch means included in a drive of said feed roller and operatively connected to an output of said second means; said switch means being arranged to be opened in response to the sensor signal for stopping the rotation of said feed roller in response to the presence of a metallic foreign body in the high-frequency electromagnetic field.

2. A detector apparatus as defined in claim 1, wherein said lap feed ramp consists of a synthetic material.

3. A detector apparatus as defined in claim 1, wherein said lap feed ramp is inclined downwardly towards said feed roller.

4. A detector apparatus as defined in claim 1, further comprising a transducer connected between said switch means and said second means for applying to said switch means an actuating signal in response to said sensor signal.

5. In a detector apparatus for stopping the rotation of a feed roller of a carding machine in the presence of a metallic foreign body in a textile lap advancing to the feed roller, the improvement comprising (a) a lap feed ramp arranged at said feed roller for supporting the lap;

(b) first means for generating a high-frequency electromagnetic field in the zone of said lap feed ramp substantially along the entire width thereof measured transversely to the direction of lap advance; said first means comprising an oscillator means for generating a high-frequency voltage and a component supported in the zone of said lap feed ramp and connected to said oscillator means to receive said high-frequency voltage for generating said high-frequency electromagnetic field; said component having two field-generating parts; one of said parts being attached to an underside of said lap feed ramp and the other of said parts being arranged above said lap feed ramp;

(c) second means for deriving a sensor signal in response to an alteration of the high-frequency electromagnetic field caused by the presence of a metallic foreign body in said field; and (d) a switch means included in a drive of said feed roller and operatively connected to an output of said second means; said switch means being arranged to be opened in response to the sensor signal for stopping the rotation of said feed roller in response to the presence of a metallic foreign body in the high-frequency electromagnetic field.

6. A detector apparatus as defined in claim 5, wherein said lap feed ramp consists of a synthetic material.

7. A detector apparatus as defined in claim 5, wherein said lap feed ramp is inclined downwardly towards said feed roller.

8. A detector apparatus as defined in claim 5, further comprising a transducer connected between said switch means and said second means for applying to said switch means an actuating signal in response to said sensor signal.

9. In a detector apparatus for stopping the rotation of a feed roller of a carding machine in the presence of a metallic foreign body in a textile lap advancing to the feed roller, the improvement comprising (a) a lap feed ramp arranged at said feed roller for supporting the lap;

(b) first means for generating a high-frequency electromagnetic field in the zone of said lap feed ramp substantially along the entire width thereof measured transversely to the direction of lap advance; said first means comprising a transmitter for generating a high-frequency voltage and a transmitting antenna connected to said transmitter and arranged in the zone of said lap feed ramp for generating said high-frequency electromagnetic field;

(c) second means for deriving a sensor signal in response to an alteration of the high-frequency electromagnetic field caused by the presence of a metallic foreign body in said field; said second means comprising a receiving antenna arranged in the effective range of said transmitting antenna and a receiver connected with said receiving antenna; and (d) a switch means included in a drive of said feed roller and operatively connected to an output of said second means; said switch means being arranged to be opened in response to the sensor signal for stopping the rotation of said feed roller in response to the presence of a metallic foreign body in the high-frequency electromagnetic field.

10. A detector apparatus as defined in claim 9, wherein each said antenna is loop-shaped and surrounds said lap feed ramp.

11. A detector apparatus as defined in claim 10, wherein said antennae are in alignment as viewed in the direction of feed on said lap feed ramp.

12. A detector apparatus as defined in claim 11, further comprising a support frame surrounding said lap feed ramp; said antennae being carried by said frame.

13. A detector apparatus as defined in claim 12, wherein said antennae are embedded in said frame.

14. A detector apparatus as defined in claim 9, wherein said lap feed ramp consists of a synthetic material.

15. A detector apparatus as defined in claim 9, wherein said lap feed ramp is inclined downwardly towards said feed roller.

16. A detector apparatus as defined in claim 9, further comprising a transducer connected between said switch means and said second means for applying to said switch means an actuating signal in response to said sensor signal.

* * * * *